US005447254A

United States Patent [19]

Hoover et al.

[11] Patent Number: 5,447,254

[45] Date of Patent: Sep. 5, 1995

[54] FLUID DISPENSER WITH SHUT-OFF DRIP PROTECTION

[75] Inventors: Scott C. Hoover, Elyria; Kenneth Jeffrey, Cleveland; George O. Porter, Amherst, all of Ohio

[73] Assignee: Nordson Corporation, Westlake, Ohio

[21] Appl. No.: 153,660

[22] Filed: Nov. 16, 1993

[51] Int. Cl.[6] ..... B67B 7/00

[52] U.S. Cl. ..... 222/1; 222/148; 222/571

[58] Field of Search ..... 222/148, 334, 637, 571, 222/1; 239/112

[56] References Cited

U.S. PATENT DOCUMENTS

| | | | |
|---|---|---|---|
| 3,315,899 | 4/1967 | Quarve . | |
| 3,841,567 | 10/1974 | Drozek et al. . | |
| 3,905,552 | 9/1975 | Hall et al. | 239/112 X |
| 4,408,562 | 10/1983 | DeCamp et al. . | |
| 4,721,252 | 1/1988 | Colton . | |
| 4,768,718 | 9/1988 | Faulkner, III . | |
| 4,891,249 | 1/1990 | McIntyre . | |
| 4,928,883 | 5/1990 | Weinstein . | |
| 4,970,985 | 11/1990 | Slautterback . | |
| 5,048,454 | 9/1991 | Berntsson . | |
| 5,207,352 | 5/1993 | Porter et al. . | |
| 5,226,565 | 7/1993 | Hladis et al. | 239/112 X |

*Primary Examiner*—Gregory L. Huson

*Attorney, Agent, or Firm*—Wood, Herron & Evans

[57] ABSTRACT

A dispenser which prevents dripping and drooling of liquid material upon shut off of the dispenser, especially during intermittent dispensing operations. The first embodiment includes a nozzle body and nozzle fitting which include liquid flow passageways and together form an air passageway which communicates with a discharge passageway upstream of the discharge end of the nozzle fitting. Exhaust air from the dispenser is directed into the air passageway such that excess liquid material is blown out of the discharge passageway and off of the discharge end of the nozzle fitting immediately upon shut off of the dispenser. A second embodiment incorporates this anti-drip and anti-drool feature directly into the valve and valve stem of the dispenser by providing the air passageway through the valve and valve stem.

15 Claims, 2 Drawing Sheets

FLUID DISPENSER WITH SHUT-OFF DRIP PROTECTION

BACKGROUND OF THE INVENTION

The present invention generally relates to intermittent dispensing processes and apparatus involving liquid materials such as hot melt adhesives, cold glues and sealants. More particularly, the present invention relates to a dispensing head or nozzle which prevents drooling or dripping of such adhesives or glues during the shut off period upon completion of a dispensing operation.

In an intermittent dispensing operation of, for example, hot melt adhesives or cold glues, the shut off periods between the dispensing operations present opportunity for accumulated adhesive or glue in the dispensing head or nozzle to drip or drool from the dispensing head. Often, this dispenses adhesive or glue in unwanted locations such as, for example, in undesirable locations on the substrate or on the conveyor system which transports the substrate. Certain solutions to this problem have been presented in the prior art. One solution is contained in U.S. Pat. No. 3,315,899 which discloses a dispensing body having a piston which is raised into the body upon shut off of the nozzle to decrease the pressure in a chamber within the nozzle. This decrease in pressure pulls hot melt at the nozzle outlet back into the chamber to prevent drooling or dripping of adhesive after shut off. The drawback with this design, however, is that the adhesive drawn back into the chamber must be expelled at the beginning of the next dispensing cycle. Also, dripping will still occur with this design if the discharge orifice is large enough and/or depending on the physical properties of the dispensed liquid.

U.S. Pat. No. 3,841,567 discloses a dispensing nozzle having a minimum volume cavity above the nozzle supply passage and a nozzle tip having a minimal lip area which, taken together, prevent drooling or dripping of material from the nozzle tip after shut off. This solution to the drooling problem is unacceptable in dispensing applications requiring nozzles having large dispensing passageways or in situations where there is otherwise a need to shape or control the stream of material exiting the nozzle.

U.S. Pat. No. 4,408,562 discloses an air wipe method and apparatus for preventing drooling or dripping of material upon shut off of a coating dispenser. More specifically, a pressurized air supply is positioned adjacent to the nozzle outlet to direct a pressurized stream of air in a direction transverse to the direction of the stream of material exiting the nozzle. Upon shut off of the nozzle, the pressurized air is directed in this transverse manner to wipe off or clean the nozzle by blowing any excess or accumulated material on the nozzle back onto the just applied bead. Unfortunately, this method cannot be used in situations in which the transverse blowing action will in some way disturb the desired bead pattern in an unacceptable fashion.

Finally, U.S. Pat. No. 4,970,985 discloses a dispensing apparatus and method for reducing hot melt adhesive tailing. A plurality of air jets surrounding the discharge and of the nozzle are utilized to direct individual pressurized air streams which strike the adhesive tailing of the dispensed material to follow the desired pattern of the just applied adhesive. The prevention of drooling or dripping from the discharge end of the nozzle itself is not adequately addressed or corrected by the apparatus of U.S. Pat. No. 4,970,985. More specifically, while the "tail" of the bead may be impacted by the air streams to urge the tailing to follow the desired pattern of the applied bead, the discharge passage of the nozzle is left unaffected by the air streams. Therefore the air streams do not prevent dripping and drooling of adhesive from the discharge passage upon shut off.

It has therefore been an object of the present invention to prevent dripping and drooling of material from a dispensing head or nozzle during the shut off period of an intermittent dispensing operation which solves the above-mentioned problems in the art.

It has been another object of the present invention to provide an anti-dripping or anti-drooling nozzle which is easily adapted to operate with a wide variety of intermittent dispensing devices.

It has been a further object of the invention to provide such an anti-dripping or anti-drooling dispensing head which efficiently operates off the exhaust air of the dispenser to provide a quick and full shut off of material from the dispensing head.

SUMMARY OF THE INVENTION

To these ends, the present invention generally comprises an anti-drip system for a dispensing nozzle wherein the nozzle includes an internal polymer flow passageway for directing polymeric material to a discharge end thereof during a dispensing cycle and at least one air passageway preferably communicating with the internal polymer flow passageway at a location upstream of the discharge end of the dispenser. Means are provided for directing pressurized air into the air passageway during the shut off cycle and preferably immediately upon shut off of the dispensing cycle for blowing accumulated polymeric material out of the discharge end of the dispenser. In the preferred embodiments, the pressurized air is provided by the exhaust of air from the piston that operates the dispenser.

A first preferred embodiment of the present invention includes a nozzle fitting having a polymer flow passageway with a discharge end and at least one air passageway. The nozzle fitting is adapted to fit over a nozzle body disposed at the discharge end of a conventional fluid dispenser. The dispenser includes a valve seat which is engaged by a valve for controlling the on/off cycling of polymeric material through the discharge end of the dispenser. The nozzle fitting is attachable to the nozzle body at the discharge end of the dispenser such that the air passageway communicates with the polymer flow passageway just downstream of the valve seat but upstream of the discharge end of the fitting. The discharge end of the fitting preferably takes the form of a frusto-conical tip extending outwardly from the valve seat. The fitting includes one and preferably two or more air inlet ports communicating with the air passageway. The air passageway is preferably a continuous annular space formed between the dispenser's nozzle body and the nozzle fitting of the invention. More particularly, the air passageway is located between the valve seat of the dispenser and an inner surface of the fitting.

In the first preferred embodiment, the means for directing pressurized air into the air passageway includes an air line connected between the air inlet port or ports of the fitting and the exhaust port of the dispenser. This design ensures immediate material blow off as the valve is shut off since pressurized air within the dispenser will be directed into the exhaust port as the dispenser is shut off. Alternatively, a separate air pressure system may be connected to the nozzle fitting and appropriately controlled to direct air into the air passageway of the fitting upon shut off of the dispenser. For example, this may be accomplished by way of a solenoid valve which receives a signal through a control system tied to the operation of the dispenser.

In a second preferred embodiment, rather than utilizing a separate fitting, an anti-drip system is incorporated directly into a pneumatically operated dispenser having a valve which operates against a valve seat. An air passageway extends centrally through the valve and the valve contacts a valve seat upstream of the discharge end of the dispensing nozzle such that when pressurized air is directed into the air passageway upon shut off of the dispenser, accumulated polymeric material located between the valve and the discharge end of the nozzle is effectively blown out. Like the first embodiment, means are provided for directing pressurized air into the air passageway during the shut off cycle and, more preferably, immediately upon shut off of material flowing from the dispenser. Preferably, the air passageway further extends through a valve stem connected to the valve and a check valve is disposed at the inlet end of the air passageway for allowing passage of pressurized air only in a direction toward the discharge end of the dispenser nozzle.

The valve in the nozzle of the second embodiment is also preferably part of a pneumatically operated dispenser and the means for directing pressurized air into the air passageway is, like the first embodiment, preferably an air line connecting the air passageway to an exhaust port of the pneumatically operated dispenser. More specifically, the air line is connected to the check valve to thereby direct the exhaust air from the dispenser through the check valve in the direction of the discharge end of the nozzle immediately upon shut off of the dispenser. Alternatively, the check valve may be connected to an air line which operates to direct pressurized air from another air source immediately upon shut off of the dispenser such as, for example, through the use of a solenoid valve which receives an appropriate signal from a control system.

These and other objects and advantages of the invention will become more readily apparent to those of ordinary skill in the art upon review of the following detailed description of the preferred embodiments taken in conjunction with the accompanying drawings.

DETAILED DESCRIPTION OF THE PREFERRED EMBODIMENTS

Figure 1:
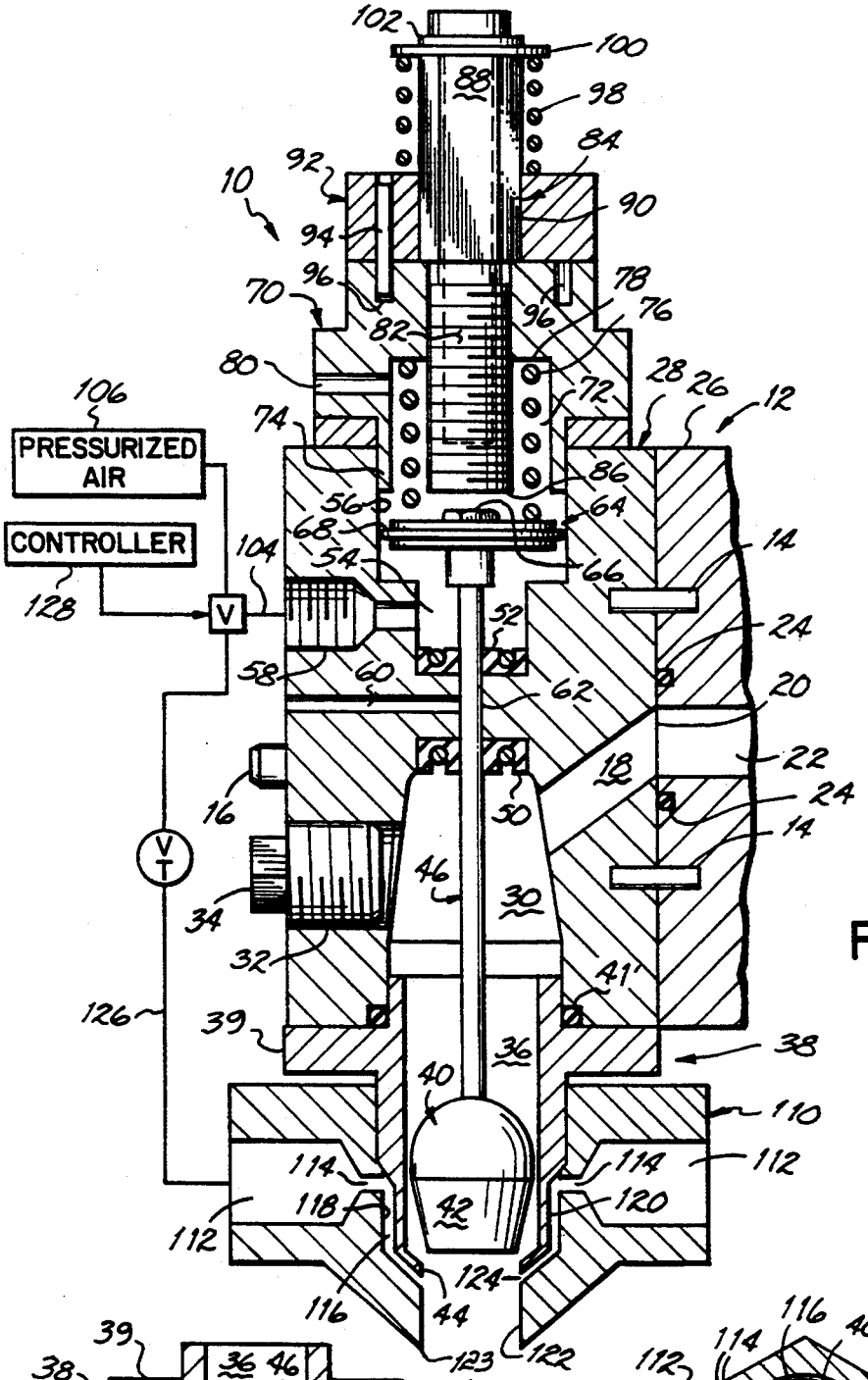
FIG. 1 is a schematic view in partial cross-section of a dispenser including the nozzle fitting constructed according to the first preferred embodiment of the invention.

Referring first to FIG. 1, a first embodiment of the present invention is shown in conjunction with a dispenser 10 which may, for example, be the dispenser shown in U.S. Pat. No. 5,207,352 which is assigned to the assignee of the present invention. U.S. Pat. No. 5,207,352 is hereby fully and expressly incorporated by reference herein. The dispenser 10 is located with respect to a pressure regulator 12, more fully detailed in the above-mentioned patent, by pins 14 and is rigidly secured to the pressure regulator 12 by screws 16, one of which is shown in FIG. 1. The dispenser 10 includes a fluid passageway 18 which has an inlet 20 directly connected to the outlet passageway 22 of the pressure regulator 12. This connection is sealed by an O-ring 24 to provide a face seal between mounting block 26 of the pressure regulator 12 and the dispenser body 28. The fluid passageway 18 is connected to a discharge cavity 30 formed near the base of the dispenser body 28 which is intersected by an internally threaded port 32. The threaded port 32 is closed by a plug 34 but may also mount a pressure transducer (not shown) as more fully described in U.S. Pat. No. 5,207,352. The discharge cavity 30 in the dispenser body 28 communicates with a central bore 36 located within a nozzle body 38 of the dispenser 10. The nozzle body 38 is attached to the dispenser body 28 by way of a flange 39 rigidly mounted in a suitable manner at the bottom of the dispenser body 28. A sealing connection is made between the dispenser body 28 and the flange 39 with an O-ring 41.

The dispenser 10 further includes a valve 40 having a valve tip 42 which tapers inwardly toward an outer end thereof and contacts a valve seat 44 disposed at the outer or lower end of the nozzle bore 36. A valve stem 46 is connected to the valve 40. The upper or inner end of the needle valve stem 46 is guided by a first seal 50 mounted at the top of discharge cavity 30, and a second seal 52 mounted within an air cavity 54 defined by a stepped bore 56 formed in the top of dispenser body 28. The air cavity 54 is intersected by an air inlet port 58. An air or sealant weep port 60 is formed in the dispenser body 28 beneath the upper or second seal 52 of air cavity 54. This port 60 intersects a bore 62 which receives that portion of the valve stem 46 extending between the discharge cavity 30 and the air cavity 54. A piston 64 is mounted by a screw 66 to the uppermost end of the needle valve stem 46 and is axially movable within the air cavity 54. Preferably, the piston 64 carries an annular seal 68 which engages the wall of the stepped bore 56 to provide a dynamic seal therebetween.

Referring to the top of FIG. 1, adjustment structure is provided to control the extent of axial movement of the needle valve 40 which, in turn, controls the flow of fluid past the valve 40. The adjustment structure comprises a collar 70 mounted by fasteners (not shown) to the top of dispenser body 28. The collar 70 is formed with a bore 72 which defines an annular projection 74 insertable within the upper portion of the stepped bore 56 in the dispenser body 28. A return spring 76 is carried within bore 72 and extends between the top of piston 64 and a shoulder 78 formed at the top end of bore 72. A vent passage 80 is formed in collar 70 which intersects bore 72.

The upper end of bore 72 is threaded to receive the threaded portion 82 of an adjustment shaft 84 such that the lowermost end 86 of shaft 84 is axially aligned with the screw 66 of piston 64. The top portion of the adjustment shaft 84 is formed with a noncircular portion 88 which may, for example, be hexagonal in shape, and which is received within a mating bore 90 formed in a knurled ring 92. This ring 92 rests atop the collar 70 and is held in a rotatably fixed position with respect to the collar 70 by a pin 94 extending therebetween. The pin 94 is fixedly mounted to the ring 92 and is sized to engage one or more bores 96 formed in the collar 70, two of which are shown in FIG. 1. Because the ring 92 and adjustment shaft 84 are interconnected along the noncircular portion 88 of shaft 84, the shaft 84 is also held in a rotatably fixed position when the ring 92 is mounted to the collar 70. A spring 98 is interposed between the top of ring 92 and a washer 100 mounted at the top of adjustment shaft 84 by a snap ring 102 to retain the ring 92 in engagement with the top of collar 70.

Axial movement of the needle valve 40 to operate the dispenser 10 occurs in the following manner. The needle valve 40 is normally maintained in a closed position against valve seat 44 by the return spring 76. In the closed position, valve tip 42 of needle valve 40 seats against valve seat 44. In order to move the needle valve 40 to an open position, pressurized air is introduced into cavity 54 through port 58 by way of an air line 104 connected to a source of pressurized air 106. The flow of pressurized air through line 104 is preferably controlled by a three way valve "V", which is operated by a controller 128 such as disclosed in the above-mentioned U.S. Pat No. 5,207,352. The pressurized air forces the piston 64 and, in turn, the needle valve 40 upwardly as viewed in FIG. 1. This unseats the valve tip 42 from the valve seat 44 and allows fluid to flow through the nozzle 38.

Figure 2:
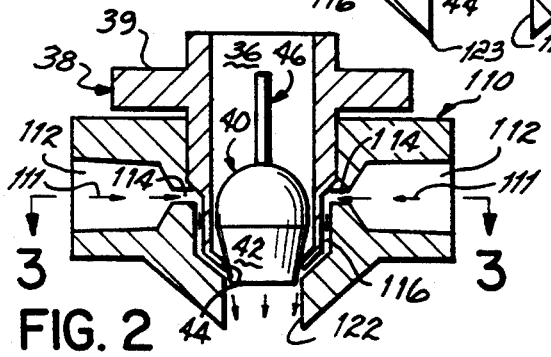
FIG. 2 is a cross-sectional view of the nozzle fitting as well as the valve of the dispenser shown in FIG. 1 with the valve shown in a "closed" or "off" condition and pressurized air being directed through the nozzle fitting of the invention.
Figure 3:
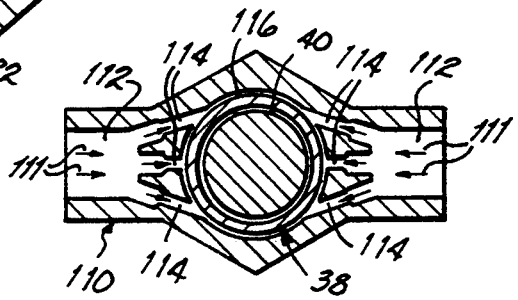
FIG. 3 is a cross-sectional view taken along 3—3 of FIG. 2.

The discharge end of the dispenser 10 further includes a nozzle fitting 110 which surrounds the discharge end of the nozzle body 38 and the valve seat 44 thereof. As shown in FIGS. 1–3, the fitting 110 includes at least one and preferably more than one air inlet 112 leading to a plurality of air passageways 114 disposed within the fitting 110 (see FIG. 3). The passageways 114 lead to an annular space 116 disposed between an inner surface 118 of the fitting 110 and an outside surface 120 of the nozzle body 38. The fitting 110 includes a fluid discharge outlet passage or bore 122 disposed downstream of the valve seat 44 and having a discharge end 123 disposed downstream of the location 124 at which the annular space 116 communicates with discharge passage 122.

As further shown in FIG. 1, an air line 126 connects the three way valve "V" to the inlet or inlets 112 of the fitting 110. Line 126 further includes a throttle valve "VT" which may more specifically be a needle valve. The valve "VT" allows regulation or adjustment of the pressurized air being directed to inlets 112. For example, if a relatively low viscosity liquid dispensing material or a relatively large discharge orifice 122 is utilized, then throttling back the air pressure using valve "VT" will help avoid spattering of accumulated or excess liquid material upon discharge thereof in the manner explained below. As mentioned previously, the valve "V" is controlled by a controller 128 to operate the dispenser 10 in an intermittent fashion as detailed in U.S. Pat. No. 5,207,352. If more than one inlet 112 is utilized, then suitable fluid lines and fittings (not shown) are contemplated to be used to connect such plural inlets 112 together. Thus, it will be appreciated that when the dispenser 10 is shut off air from the air cavity 54 will be forced into the air inlet or inlets 112 of the fitting 110 by traveling through port 58, air line 104, valve "V" and air line 126. As illustrated by the arrows 111 in FIGS. 2 and 3, the air will travel through the inlets 112 and passageways 114 to the annular space 116 such that it exits at 124 into the discharge passage 122 and forces any excess liquid material out of discharge passage 122 and off of the discharge end 123 of the fitting 110. In this way, dripping and drooling of liquid polymeric material from the dispenser 10 is effectively prevented after shut-off of the dispenser 10.

Figure 4:
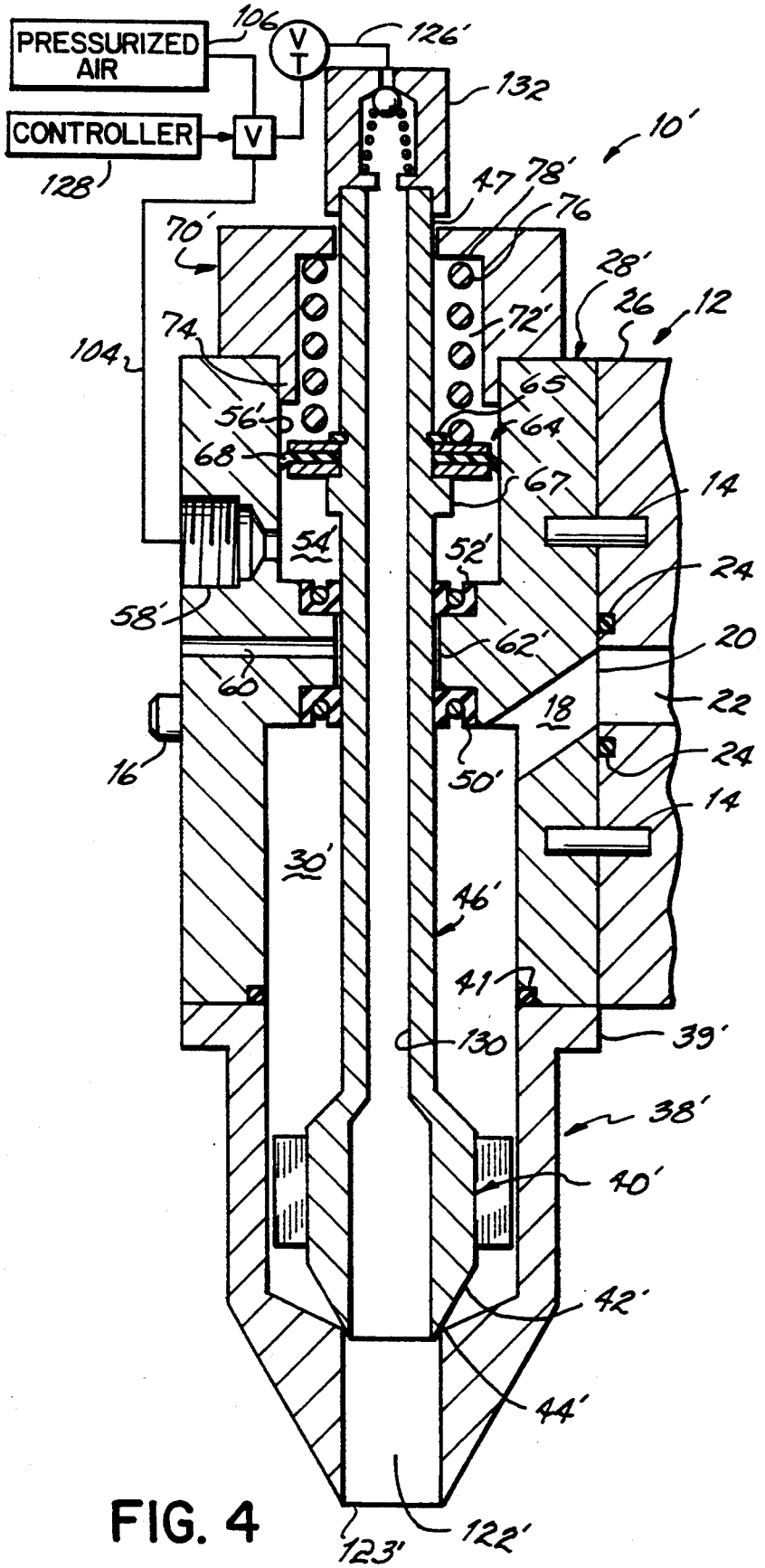
FIG. 4 is a cross-sectional view of a dispensing nozzle constructed according to a second preferred embodiment of the present invention.

A second embodiment of the present invention is diagrammatically shown in FIG. 4 wherein like reference numerals have been used to indicate like structure between the embodiment of FIGS. 1–3 and the embodiment of FIG. 4. Modified structure in FIG. 4 is represented by the reference numerals used in FIGS. 1–3 but with a prime mark while new structure is indicated by new and different reference numerals.

The dispenser 10' of the second embodiment is similar in operation to the dispenser 10 of the first embodiment although shown in simpler form which does not include, for example, the adjustment structure or pressure transducer port thereof. More specifically, the dispenser 10 is located with respect to a pressure regulator 12 by pins 14 and is rigidly secured to the pressure regulator 12 by screws 16, one of which is shown in FIG. 4. The dispenser 10' includes a fluid passageway 18 which has an inlet 20 directly connected to the outlet passageway 22 of the pressure regulator 12. This connection is sealed by an O-ring 24 to provide a face seal between mounting block 26 of the pressure regulator 12 and the dispenser body 28'. The fluid passageway 18 is connected to a discharge cavity 30' formed near the base of the dispenser body 28'. The discharge cavity 30' in the dispenser body 28' communicates with a central discharge passageway 122' disposed within a nozzle body 38'. The nozzle body 38' is attached to the dispenser body 28' by way of a flange 39' rigidly mounted in a suitable manner at the bottom of dispenser body 28'. A sealing connection is made between the dispenser body 28' and the flange 39' within O-ring 41.

The dispenser 10' further includes a valve 40' having a valve tip 42' which is frusto-conically shaped and tapers inwardly toward an outer end thereof and, when the dispenser 10' is in an "off" condition, the valve tip 42' seats against a valve seat 44' disposed at the outer or lower end of the discharge cavity 30'. A valve stem 46' is connected to the valve 40'. The valve stem 46' is guided by a first seal 50' mounted at the top of discharge cavity 30' and a second seal 52' mounted within an air cavity 54' defined by a bore 56' formed in the top of dispenser body 28'. The air cavity 54' is intersected by an air inlet port 58'. An air or sealant weep port 60 is formed in the dispenser body 28' beneath the upper or second seal 52' of air cavity 54'. This port 60 intersects a bore 62' which receives that portion of the valve stem 46' extending between the discharge cavity 30' and the air cavity 54'. A piston 64 is mounted by way of a retaining ring 65 against a flanged portion 67 of the valve stem 46' and is axially movable within the air cavity 54'. Preferably, the piston 64 carries an annular seal 68 which engages the wall of the bore 56' to provide a dynamic seal therebetween.

A collar 70' is affixed to the top of the dispenser body 28' and includes a bore 72' which defines an annular projection 74' insertable within the upper portion of the stepped bore 56'. A return spring 76 is carried within bore 72' and extends between the top of piston 64 and a shoulder 78' formed at the top end of bore 72'.

Axial movement of the needle valve 40' to operate the dispenser 10' occurs in the following manner. The needle valve 40' is normally maintained in a closed position against valve seat 44' by the return spring 76 as shown in FIG. 4. In the closed position, valve tip 42' of needle valve 40' seats against valve seat 44'. In order to move the needle valve 40' to an open position to thus allow fluid flow, e.g., hot melt adhesive flow, through the discharge passageway 122', pressurized air is introduced into cavity 54' through port 58' by way of an air line 104 connected to a source of pressurized air 106. The flow of pressurized air through line 104 is preferably controlled by a three way valve "V" which may be operated by the same controller 128 (or a similar controller) as in the first embodiment. The pressurized air forces the piston 64 and, in turn, the needle valve 40' upwardly as viewed in FIG. 4. This unseats the valve tip 42' from the valve seat 44' and allows fluid to flow through the nozzle 38' and, more specifically, through the discharge passageway 122'.

The anti-drip or drool feature of the second embodiment is provided by an air passageway 130 disposed centrally within the valve stem 46' and leading from an upper end 47 of the stem 46' to the valve 40' at the lower end thereof. The air passageway 130 thus communicates with discharge passageway 122' upstream of its discharge end 123'. A check valve 132 is attached at the upper end 47 of the valve stem 46' and is preferably connected to an exhaust air line 126' having a throttle valve "VT" and connected to the exhaust port of three-way valve "V". Throttle valve "VT" has the same purpose and function as explained in regard to the first embodiment. The check valve 132, which is shown diagrammatically, allows air to travel therethrough only in the direction of the nozzle body 38'. Thus, it will be appreciated that when the controller 128 causes the valve "V" to exhaust chamber 54', for example, during a shut off period, thereby allowing the spring 76 to force the valve stem 46' downwardly such that the valve 40' seats against the valve seat 44', the exhaust pressure from chamber 54' will immediately be directed through air lines 104, 126', valves "V" and "VT" and check valve 132, and through central passageway 130 of valve stem 46' and valve 40'. This air pressure thus forces any excess or accumulated liquid dispensing material from the discharge passageway 122' of the nozzle body 38' and off of discharge end 123' to prevent dripping or drooling thereof upon shut-off of the dispenser 10'.

It will be appreciated that the teachings of the present invention are readily adaptable to many types of dispensing devices which intermittently dispense liquids other than those specifically shown and described herein. Also, the nozzle body 38 and nozzle fitting 110 of the first embodiment may be integrally formed as a unit with an air passageway or passageways extending therethrough to a fluid discharge passageway. Moreover, the nozzle body/nozzle fitting combination of the first embodiment as well as the nozzle body of the second embodiment may be formed integrally with the respective dispenser bodies. Finally, the use of such terms as "upper", "lower", "top" and "bottom" throughout the specification and claims hereof is for spacial reference purposes for describing one possible orientation of the invention and is not meant to limit the invention to this particular orientation.

It will be further appreciated by those of ordinary skill in the art that many other modifications of the above-described preferred embodiments may be made without departing from the scope of the inventive concepts disclosed herein. Therefore, applicant intends to be bound only by the scope of the claims appended hereto.

What is claimed is:

1. A fluid dispenser for use in intermittent dispensing operations, said dispenser having a fluid inlet communicating with an internal fluid passageway and a discharge passageway having a discharge end, said dispenser further comprising:

a valve carried by a dispenser body and movable with respect to said dispenser body and with respect to a valve seat disposed upstream of said discharge end;

at least one air passageway in said dispenser communicating with said fluid discharge passageway upstream of said discharge end; and, a controlled source of pressurized air operatively connected to said air passageway for directing air into said air passageway upon shutoff of a fluid dispensing operation of said dispenser for blowing accumulated fluid material out of said discharge passageway.

2. The dispenser of claim 1 wherein said dispenser is pneumatically operated and said controlled source of pressurized air comprises exhaust air from said dispenser.

3. The dispenser of claim 1 further comprising:

a nozzle body attached to said dispenser body, wherein said nozzle body and said dispenser body include communicating flow passageways, and a nozzle fitting attached to said nozzle body, said nozzle fitting including said discharge passageway and discharge end of said discharge passageway.

4. The dispenser of claim 3 wherein said dispenser is pneumatically operated and said controlled source of pressurized comprises exhaust air from said dispenser.

5. The dispenser of claim 3 wherein said nozzle fitting surrounds said nozzle body and said air passageway is disposed between said nozzle body and said nozzle fitting.

6. The dispenser of claim 5 wherein said air passageway is formed by a continuous annular space surrounding said valve seat and being disposed between said valve seat and said nozzle fitting and communicating with said discharge passageway immediately downstream of said valve seat.

7. The dispenser of claim 1 further comprising a nozzle body attached to a dispenser body, said nozzle body including said discharge passageway.

8. The dispenser of claim 7 wherein said dispenser is pneumatically operated and said controlled source of pressurized air comprises exhaust air from said dispenser.

9. The dispenser of claim 7 wherein said air passageway extends through said valve.

10. The dispenser of claim 8 further comprising a valve stem connected to said valve, wherein said air passageway further extends through said valve stem.

11. The dispenser of claim 10 further comprising a check valve connected to said valve stem for allowing passage of pressurized air through said air passageway only in the direction of said discharge end.

12. The dispenser of claim 1 further comprising a throttle valve operatively connected between said controlled source of pressurized air and said air passageway.

13. A method of intermittently dispensing fluid from a dispenser, the dispenser including a fluid discharge passageway having a discharge end and an air passageway communicating with said discharge passageway upstream of said discharge end, the method comprising the steps of:

(a) dispensing fluid from said dispenser through said discharge passageway, (b) stopping the flow of fluid through said discharge passageway, and (c) directing pressurized air through said air passageway to blow out any excess fluid from said discharge passageway.

14. The method of claim 13 wherein said dispenser is a pneumatically operated dispenser having an exhaust port and step (c) further comprises:

directing air from said exhaust port into said air passageway upon stopping the flow of fluid through said discharge passageway.

15. A fluid dispenser for use in intermittent dispensing operations, said dispenser having a fluid inlet communicating with an internal fluid passageway and a discharge passageway having a discharge end, said dispenser further comprising:

a valve carried by a dispenser body and movable with respect to said dispenser body and with respect to a valve seat disposed upstream of said discharge end;

at least one air passageway in said dispenser communicating with said fluid discharge passageway upstream of said discharge end;

a controlled source of pressurized air operatively connected to said air passageway for directing air into said air passageway upon shutoff of a fluid dispensing operation of said dispenser and thereby blowing accumulated fluid material out of said discharge passageway;

a nozzle body attached to said dispenser body, wherein said nozzle body and said dispenser body include communicating flow passageways;

a nozzle fitting attached to said nozzle body, said nozzle fitting including said discharge passageway and discharge end of said discharge passageway; and, wherein said nozzle fitting surrounds said nozzle body and said air passageway is formed by a continuous annular space surrounding said valve seat and being disposed between said valve seat and said nozzle fitting and communicating with said discharge passageway immediately downstream of said valve seat.

* * * * *

UNITED STATES PATENT AND TRADEMARK OFFICE

CERTIFICATE OF CORRECTION

PATENT NO. : 5,447,254

DATED : September 5, 1995

INVENTOR(S) : Hoover et al.

It is certified that error appears in the above-indentified patent and that said Letters Patent is hereby corrected as shown below:

Column 8, line 42, insert "air" after "pressurized".

Signed and Sealed this

Second Day of January, 1996

*Attest:*

Bruce Lehman

BRUCE LEHMAN

*Attesting Officer*

*Commissioner of Patents and Trademarks*